US005841230A

United States Patent [19]

Ikoma et al.

[11] Patent Number: 5,841,230

[45] Date of Patent: Nov. 24, 1998

[54] ELECTROLUMINESCENT LIGHTING ELEMENT WITH A LIGHT-PERMEABLE REFLECTION LAYER AND MANUFACTURING METHOD FOR THE SAME

[75] Inventors: Heiji Ikoma; Koji Tanabe; Yosuke Chikahisa, all of Osaka, Japan

[73] Assignee: Matsushita Electric Industrial Co., Ltd., Osaka, Japan

[21] Appl. No.: 804,963

[22] Filed: Feb. 24, 1997

[30] Foreign Application Priority Data

Mar. 4, 1996 [JP] Japan ..... 8-045751

[51] Int. Cl.[6] ..... H05B 33/00

[52] U.S. Cl. ..... 313/506; 313/509; 313/512; 313/113

[58] Field of Search ..... 313/506, 501, 313/509, 512, 113; 315/169.3; 428/917, 690

[56] References Cited

U.S. PATENT DOCUMENTS

| | | | |
|---|---|---|---|
| 3,932,881 | 1/1976 | Mita et al. . | |
| 4,138,195 | 2/1979 | Saurer et al. | 350/345 |
| 4,168,102 | 9/1979 | Chida et al. | 313/512 X |
| 4,590,128 | 5/1986 | Kawai | 313/509 X |
| 4,613,793 | 9/1986 | Panicker et al. | 315/169.3 |
| 4,614,668 | 9/1986 | Topp et al. | 427/66 |
| 4,758,765 | 7/1988 | Mitsumori | 313/506 |
| 4,767,679 | 8/1988 | Kawachi | 428/690 |
| 5,003,221 | 3/1991 | Shimizu | 313/509 |
| 5,019,748 | 5/1991 | Appelberg | 313/169.3 |
| 5,315,491 | 5/1994 | Spencer et al. | 313/512 X |
| 5,488,266 | 1/1996 | Aoki et al. | 313/509 |
| 5,491,377 | 2/1996 | Janusaukas | 313/506 |
| 5,491,378 | 2/1996 | Lee et al. | 313/113 X |
| 5,552,679 | 9/1996 | Murasko . | |
| 5,650,692 | 7/1997 | Vetanen et al. | 313/506 |

FOREIGN PATENT DOCUMENTS

| | | |
|---|---|---|
| 0615401 | 9/1994 | European Pat. Off. . |
| 6-251876 | 9/1994 | Japan . |
| WO9634514 | 10/1996 | WIPO . |
| WO9707653 | 2/1997 | WIPO . |

*Primary Examiner*—Ashok Patel
*Attorney, Agent, or Firm*—Pollock, Vande Sande & Priddy

[57] ABSTRACT

On an upper surface of an insulating transparent film, a transparent electrode layer, a phosphor layer, a dielectric layer, a back-surface electrode, collecting electrode layers, and an insulating coat layer are successively accumulated in predetermined patterns by repeating screen printing operations. Meanwhile, a light-permeable reflection layer containing pearly pigment is formed on a lower surface of the insulating transparent film in a predetermined pattern by a printing operation. With this arrangement, it becomes possible to eliminate the color difference of the light-emitting surface of the EL lighting element between its turned-on and turned-off conditions.

12 Claims, 1 Drawing Sheet

ELECTROLUMINESCENT LIGHTING ELEMENT WITH A LIGHT-PERMEABLE REFLECTION LAYER AND MANUFACTURING METHOD FOR THE SAME

BACKGROUND OF THE INVENTION

1. Field of the Invention

The present invention relates to an electroluminescent lighting element with a light-permeable reflection layer, which is preferably used for illumination sections of various kinds of electronic devices, and a manufacturing method for the same.

2. Related Art

Needs for EL (electroluminescent) lighting elements, thin in thickness and possessing proper surface lighting capability, have been recently increasing for the increasing use of back light means applied to liquid crystal display units and related switches incorporated in various electronic systems, such as communication devices, video components, acoustic components, and clocks.

EL lighting elements generally comprise a transparent electrode of indium-tin oxide (referred to "ITO" hereinafter) formed by a sputtering operation, a back-surface electrode made of conductive paste or aluminum foil, and an intervening layer of phosphor or insulating material interposed between the transparent electrode and the back-surface electrode. EL lighting elements emit light upon an application of AC voltage between the transparent electrode and the back-surface electrode.

In general, EL phosphors comprise base material, such as ZnS, with a very small amount of additive, such as Mn and Cu, and generate various colors with their emitting light.

Presently used EL lighting elements, of diffusion type, can generate blue-green, white and orange color lights. Of these EL lighting elements, ones used for white and orange colors basically combine blue-green color phosphors with fluorescent pigment or fluorescent dye to convert the wavelength of light emitted from the blue-green color phosphors into a different wavelength to obtain the intended colors.

However, for an EL lighting element using red fluorescent pigment or red fluorescent dye to obtain white light, there is a problem that the light-emitting surface of the EL lighting element is seen red when the EL lighting element is turned off. This is not preferable in that the color differs largely between the turned-on condition and the turned-off condition of the EL lighting element. Especially, when such an EL lighting element is used for a back light for a crystal display unit, it looks strange. Similar problem is caused in an EL lighting element obtaining orange light.

Furthermore, when a transparent electrode is formed by a printing operation, there is a problem that, during the turning-off condition of the EL lighting element, the color of a light-emitting surface looks yellow which is the original color of ITO conductive powder constituting the transparent electrode.

SUMMARY OF THE INVENTION

Accordingly, in view of the above-described problems encountered in the related art, a principal object of the present invention is to provide an excellent EL lighting element with a light-permeable reflection layer having capability of concealing undesirable colors.

According to a preferred embodiment of the present invention, a white and shiny light-permeable reflection layer, made of pearly pigment and transparent binder resin, is formed on the back surface of the insulating transparent film of the EL lighting element.

With this arrangement, when the EL lighting element is turned off, external light is subjected to multiple reflections by the pearly pigment and produces an interference color. This is effective to conceal the natural color of the light-emitting surface of the EL lighting element. Instead, the light-emitting surface looks shiny white. On the other hand, when the EL lighting element is turned on, white-color light emitted from the phosphor layer penetrates the pearly pigment. Thus, there is no substantial difference in the color of light-emitting surface of the EL lighting element between its turned-on condition and the turned-off condition.

More specifically, the EL lighting element comprises an insulating transparent film serving as a base member of the EL lighting element. A transparent electrode layer is formed on a surface of the insulating transparent film in a predetermined pattern. A phosphor layer is formed on the transparent electrode layer in a predetermined pattern by a printing operation. A dielectric layer is formed on the phosphor layer in a predetermined pattern by a printing operation. A back-surface electrode layer is formed on the dielectric layer in a predetermined pattern by a printing operation. A first collecting electrode is formed into a predetermined pattern by a printing operation so as to have one end connected to the transparent electrode layer and the other end arranged into an external connecting portion. A second collecting electrode is formed into a predetermined pattern by a printing operation so as to have one end connected to the back-surface electrode layer and the other end arranged into an external connecting portion. An insulating coat layer is formed by a printing operation so as to cover entirely an upper surface region of the accumulated layers except for distal ends of the external connecting portions. And, a light-permeable reflection layer is formed on a back surface of the insulating transparent film in a predetermined pattern by a printing operation so as to cover a back surface of the phosphor layer.

According to the features of a preferred embodiment of the present invention, the light-permeable reflection layer is printed by using paste containing pearly pigment, such as titanium dioxide-covered mica, basic lead carbonate, bismuth oxychrolide, or natural scaly foil, diffused into transparent resin or solvent containing transparent resin. The light-permeable reflection layer contains fluorescent whitening agent. The light-permeable reflection layer contains inorganic particles, such as titanium dioxide, zinc dioxide and silicon dioxide. And, the transparent electrode layer is printed by using transparent conductive paste containing light-permeable conductive powder diffused in transparent resin.

Furthermore, the present invention provides a manufacturing method for obtaining the above-described EL lighting element. A multilayer is formed on a surface of the insulating transparent film by repeating screen printing operations so as to interpose the phosphor layer between the transparent electrode layer and the back-surface electrode layer, while a light-permeable reflection layer is formed on an opposite surface of the insulating transparent film in a predetermined pattern by a screen printing operation so as to cover a back surface of the phosphor layer.

More specifically, after the transparent electrode layer is formed on a surface of the insulating transparent film in a predetermined pattern, phosphor paste is applied on the transparent electrode layer in a predetermined pattern by a screen printing operation and then dried to form a phosphor layer. Dielectric paste is applied on the phosphor layer in a predetermined pattern by a screen printing operation and then dried to form the dielectric layer. Conductive paste is applied on the dielectric layer in a predetermined pattern by a screen printing operation and then dried to form the back-surface electrode layer. Conductive paste is applied to form first and second patterns by a screen printing operation. The first pattern has one end connected to the transparent electrode layer and the other end arranged into an external connecting portion, while the second pattern has one end connected to the back-surface electrode layer and the other end arranged into an external connecting portion. The conductive paste of first and second patterns is also dried to form the first and second collecting electrodes. Insulating paste is applied on an upper surface region of the accumulated layers except for the distal ends of the external connecting portions by a screen printing operation and is then dried to form the insulating coat layer. Meanwhile, light-permeable reflection paste is applied on an opposite surface of the insulating transparent film in a predetermined pattern by a screen printing operation so as to cover a back surface of the phosphor layer, and is then dried to form the light-permeable reflection layer.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
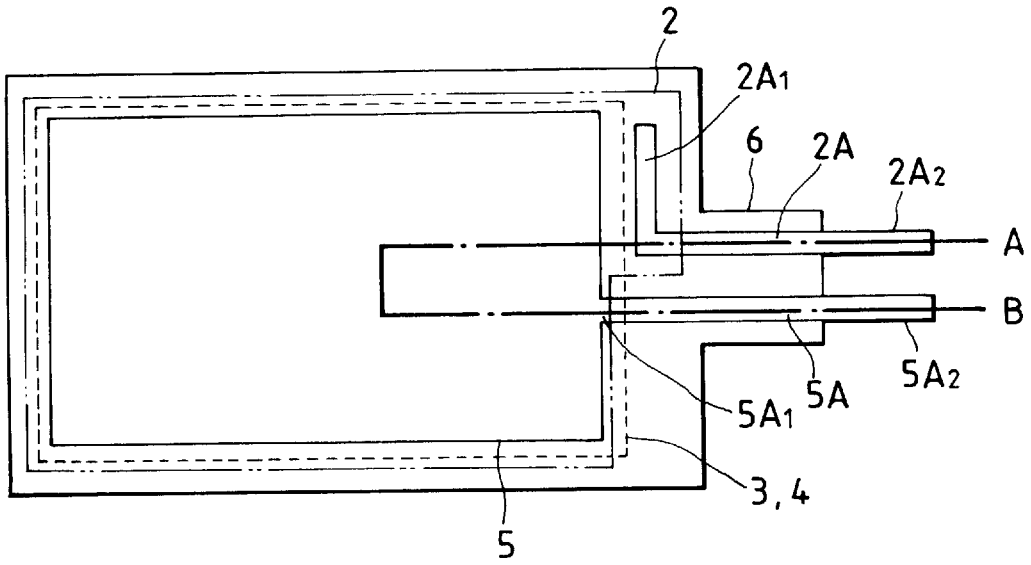
FIG. 1 is a plan view showing an EL lighting element in accordance with a preferred embodiment of the present invention.

A preferred embodiment of the present invention will be explained hereinafter with reference to accompanied drawings. Identical parts are denoted by the same reference numerals throughout the drawings.

Hereinafter, a preferred embodiment of the present invention will be explained with reference to FIGS. 1 and 2.

Figure 2:
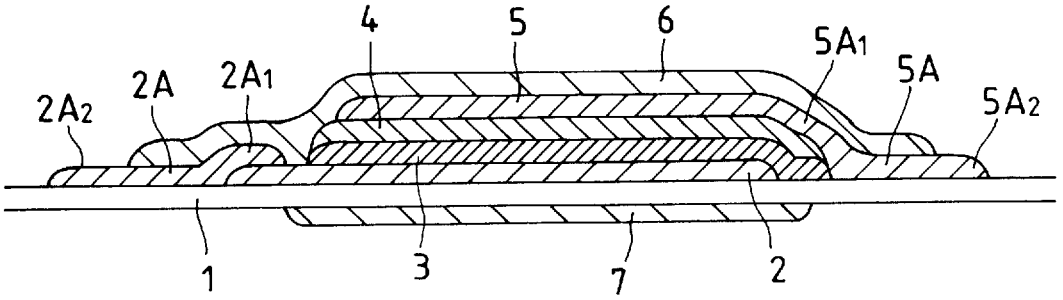
FIG. 2 is a cross-sectional view taken along a line A–B of FIG. 1.

FIG. 1 is a plan view showing an EL lighting element with a light-permeable reflection layer in accordance with a preferred embodiment of the present invention. FIG. 2 is a cross-sectional view taken along a line A–B of FIG. 1.

An EL lighting element comprises a multilayer construction consisting of an insulating transparent film 1, a transparent electrode layer 2, a phosphor layer 3, a dielectric layer 4, a back-surface electrode layer 5, a first collecting electrode 2A, a second collecting electrode 5A, an insulating coat layer 6, and a light-permeable reflection layer 7.

The insulating transparent film 1 serves as a base member of the EL lighting element. The transparent electrode layer 2 is formed on an upper (front) surface of the insulating transparent film 1 entirely or in a predetermined pattern by a printing operation. The phosphor layer 3 is formed on the transparent electrode layer 2 in a predetermined pattern by a printing operation. The dielectric layer 4 is formed on the phosphor layer 3 in a predetermined pattern by a printing operation. The back-surface electrode layer 5 is formed on the dielectric layer 4 in a predetermined pattern by a printing operation.

The first collecting electrode 2A is formed into a predetermined pattern by a printing operation so as to have one end $\mathbf{2A_1}$ connected to the transparent electrode layer 2 and the other end arranged into an external connecting portion $\mathbf{2A_2}$. The second collecting electrode 5A is formed into a predetermined pattern by a printing operation so as to have one end $\mathbf{5A_1}$ connected to the back-surface electrode layer 5 and the other end arranged into an external connecting portion $\mathbf{5A_2}$. The insulating coat layer 6 is formed by a printing operation so as to cover entirely an upper surface region of the accumulated layers except for the external connecting portions $\mathbf{2A_2}$ and $\mathbf{5A_2}$.

And, the light-permeable reflection layer 7 is formed on a back surface of the insulating transparent film 1 in a predetermined pattern by a printing operation so as to cover a back surface of the phosphor layer 5. With this arrangement, the original color of the light-emitting surface of the EL lighting element is concealed by the light-permeable reflection layer 7 when the EL lighting element is turned off.

More specifically, the light-permeable reflection layer 7 is printed by using light-permeable paste containing pearly pigment, such as titanium dioxide-covered mica, basic lead carbonate, bismuth oxychloride, or natural scaly foil, diffused into transparent resin or solvent containing transparent resin. With this arrangement, it becomes possible to produce shiny white color as well as to conceal the color of the light-emitting surface during the turned-off condition of the EL lighting element. Furthermore, due to excellent light permeability, it becomes possible to suppress the reduction of shine during the turning-on condition of the EL lighting element.

Furthermore, the light-permeable reflection layer 7 contains fluorescent whitening agent. This is effective to enhance the white color of the light-permeable reflection layer 7.

Still further, the light-permeable reflection layer 7 contains inorganic particles, such as titanium dioxide, zinc dioxide and silicon dioxide. This is effective to enhance the white color of the light-permeable reflection layer 7.

The transparent electrode layer 2 is printed by using transparent conductive paste containing light-permeable conductive powder diffused in transparent resin. This is advantageous, compared with an ITO transparent electrode formed by a sputtering operation, in that the light-permeable EL lighting element can be produced at a lower cost.

Next, a manufacturing method of the EL lighting element will be explained in more detail. The insulating transparent film 1 is made of polyethylene terephthalate having a thickness of approximately 180 $\mu$m. Transparent paste for transparent electrode layer 2 is applied on the upper surface of this insulating transparent film 1 into a predetermined pattern by a screen printing operation. The transparent paste for the transparent electrode layer 2 is light-permeable conductive paste containing needle-like ITO conductive powder (e.g., SCP-X commercially available from SUMITOMO METAL MINING CO., LTD.) and binder resin. Then, this transparent paste is dried by adding heat in a drying machine to form the transparent electrode layer 2 on the upper (i.e., front) surface of the insulating transparent film 1.

Next, phosphor paste for phosphor layer 3 is applied on the transparent electrode layer 2 into a predetermined pattern by a screen printing operation. The phosphor paste for phosphor layer 3 contains EL phosphor (e.g., TYPE 21 commercially available from OSRAM SYLVANIA INC.of the Unites States) and high dielectric binder resin (e.g., CR-S commercially available from SHIN-ETSU CHEMICAL CO., LTD.) with additive of red fluorescent pigment (e.g., NKP-9203 commercially available from NIPPON KEIKO KAGAKU CO., LTD.). And then, this phosphor paste is heated and dried in the same manner as the heat-and-drying operation above described, thereby forming the phosphor layer 3 on the transparent electrode layer 2.

Next, dielectric paste for dielectric layer 4 is applied on the phosphor layer 3 into a predetermined pattern by a screen printing operation. The dielectric paste for dielectric layer 4 contains $BaTiO_3$ (commercially available from KANTO CHEMICAL CO., INC.) and high dielectric binder resin. Then, this dielectric paste is heated and dried in the same manner as the heat-and-dry operation above described, thereby forming the dielectric layer 4 on the phosphor layer 3.

Subsequently, conductive paste for back-surface electrode layer 5 is applied on the dielectric layer 4 into a predetermined pattern by a screen printing operation. The conductive paste for back-surface electrode layer 5 contains carbon and binder resin. This conductive paste is then heated and dried in the same manner as the heat-and-dry operation above described, thereby forming back-surface electrode layer 5 on the dielectric layer 4.

In this case, the conductive paste is also applied into first and second patterns by screen printing operations. The first pattern has one end connected to the transparent electrode layer 2 and the other end arranged into an external connecting portion. The second pattern has one end connected to the back-surface electrode layer 5 and the other end arranged into an external connecting portion. The conductive paste of first and second patterns is heated and dried, thereby forming first and second collecting electrodes 2A and 5A.

Furthermore, insulating paste for insulating coat layer 6 is applied on the upper surfaces of the above-described accumulated layers except for the distal ends of the external connecting portions 2A and 5A by a screen printing operation. The insulating paste for insulating coat layer 6 is, for example, XB-803 commercially available from FUJIKURA KASEI CO., LTD. This insulating paste is then heated and dried in the same manner as the heat-and-dry operation above described, thereby forming insulating coat layer 6 so as to cover the accumulated layers.

Then, acrylic resin of 100 g and urethane resin of 30 g are mixed with titanium dioxide covered mica (TP-350 commercially available from TAYCA CORPORATION) of 2.5 g. Then, the resultant mixture is subjected to a three-roll, kneading-and-diffusing operation to obtain coating material. The resultant coating material is applied on a lower (i.e., back) surface of the insulating transparent film 1 by a screen printing operation. Then, the coating material is heated and dried in the same manner as the heat-and-dry operation above described, thereby forming the light-permeable reflection layer 7 on the back surface of the insulating transparent film 1.

As described above, the preferred embodiment of the present invention provides a manufacturing method for the EL lighting element comprising the steps of: forming a transparent electrode layer on a surface of an insulating transparent film, serving as a base member of the EL lighting element, entirely or in a predetermined pattern; accumulating phosphor paste on the transparent electrode layer in a predetermined pattern by a screen printing operation and then drying the phosphor paste to form a phosphor layer; accumulating dielectric paste on the phosphor layer in a predetermined pattern by a screen printing operation and then drying the dielectric paste to form a dielectric layer; accumulating conductive paste on the dielectric layer in a predetermined pattern by a screen printing operation and then drying the conductive paste to form a back-surface electrode layer; applying conductive paste of first and second patterns by a screen printing operation, the first pattern having one end connected to the transparent electrode layer and the other end arranged into an external connecting portion while the second pattern having one end connected to the back-surface electrode layer and the other end arranged into an external connecting portion, and then drying the paste of first and second patterns to form first and second collecting electrodes; applying insulating paste entirely on an upper surface region of the accumulated layers except for the external connecting portions by a screen printing operation and drying the insulating paste to form an insulating coat layer; and applying light-permeable reflection paste on an opposite surface of the insulating transparent film in a predetermined pattern by a screen printing operation so as to cover a back surface of the phosphor layer, and then drying the light-permeable reflection layer to form a light-permeable reflection layer on the opposite surface of the insulating transparent film.

According to the preferred embodiment of the present invention, a light-permeable reflection layer is provided on the back surface of an EL lighting element. This makes it possible to provide a shiny white color in the turned-off condition of an EL lighting element by concealing the colors appearing due to the additions of ITO powder, fluorescent pigment and fluorescent dye. Furthermore, it becomes possible to reduce the visible color difference of the light-emitting surface between the turned-on condition and the turned-off condition if the EL lighting element without largely intercepting the light emitted from the phosphor layer.

As this invention may be embodied in several forms without departing from the spirit of essential characteristics thereof, the present embodiment as described is therefore intended to be only illustrative and not restrictive, since the scope of the invention is defined by the appended claims rather than by the description preceding them, and all changes that fall within the metes and bounds of the claims, or equivalents of such metes and bounds, are therefore intended to be embraced by the claims.

What is claimed is:

1. An electroluminescent lighting element, comprising:

an insulating transparent film serving as a base member of the electroluminescent lighting element;

a pair of a transparent electrode layer and a back-surface electrode layer provided on a same side of said insulating transparent film;

a phosphor layer interposed between said transparent electrode layer and said back-surface electrode layer; and a light-permeable reflection layer formed on an opposite side of said insulating transparent film.

2. The electroluminescent lighting element in accordance with claim 1, wherein said light-permeable reflection layer contains pearly pigment diffused in transparent resin.

3. The electroluminescent lighting element in accordance with claim 2, wherein said pearly pigment is selected from the group consisting of titanium dioxide-covered mica, basic lead carbonate, bismuth oxychrolide, and natural scaly foil.

4. The electroluminescent lighting element in accordance with claim 1, wherein said light-permeable reflection layer contains fluorescent whitening agent.

5. The electroluminescent lighting element in accordance with claim 1, wherein said light-permeable reflection layer contains inorganic particles.

6. The electroluminescent lighting element in accordance with claim 5, wherein said inorganic particles are selected from the group consisting of titanium dioxide, zinc dioxide and silicon dioxide.

7. The electroluminescent lighting element in accordance with claim 1, wherein said transparent electrode layer contains light-permeable conductive powder.

8. An electroluminescent lighting element, comprising:

an insulating transparent film serving as a base member of the electroluminescent lighting element;

a transparent electrode layer formed on a surface of said insulating transparent film in a predetermined pattern;

a phosphor layer formed on said transparent electrode layer in a predetermined pattern;

a dielectric layer formed on said phosphor layer in a predetermined pattern;

a back-surface electrode layer formed on said dielectric layer in a predetermined pattern;

a first collecting electrode formed into a predetermined pattern so as to have one end connected to said transparent electrode layer and the other end arranged into an external connecting portion;

a second collecting electrode formed into a predetermined pattern so as to have one end connected to said back-surface electrode layer and the other end arranged into an external connecting portion;

an insulating coat layer formed so as to cover entirely an upper surface region of accumulated layers except for said external connecting portions; and a light-permeable reflection layer formed on an opposite surface of said insulating transparent film in a predetermined pattern so as to cover a back surface of said phosphor layer.

9. The electroluminescent lighting element in accordance with claim 8, wherein said light-permeable reflection layer contains pearly pigment diffused in transparent resin.

10. The electroluminescent lighting element in accordance with claim 8, wherein said light-permeable reflection layer contains fluorescent whitening agent.

11. The electroluminescent lighting element in accordance with claim 8, wherein said light-permeable reflection layer contains inorganic particles.

12. The electroluminescent lighting element in accordance with claim 8, wherein said transparent electrode layer contains light-permeable conductive powder.

* * * * *